United States Patent [19]
Sato et al.
[11] 4,253,933
[45] Mar. 3, 1981

[54] ELECTRODE SUBSTRATE ALLOY FOR USE IN ELECTROLYSIS

[75] Inventors: Hideo Sato, Chiba; Takayuki Shimamune, Ichihara; Toshiki Goto, Ichihara; Hideo Nitta, Ichihara, all of Japan

[73] Assignee: Permelec Electrode Ltd., Tokyo, Japan

[21] Appl. No.: 74,946

[22] Filed: Sep. 13, 1979

[30] Foreign Application Priority Data

Sep. 13, 1978 [JP] Japan ..... 53-111630

[51] Int. Cl.³ ..... C25B 11/10; C25B 11/04; C22C 27/02; C22C 14/00

[52] U.S. Cl. ..... 204/293; 204/290 F; 75/174; 75/175.5

[58] Field of Search ..... 204/290 F, 293; 75/175.5, 174

[56] References Cited

U.S. PATENT DOCUMENTS

| | | | |
|---|---|---|---|
| 3,671,226 | 6/1972 | Komata et al. | 75/174 X |
| 3,867,209 | 2/1975 | Horiuchi et al. | 75/174 X |
| 4,110,180 | 8/1978 | Nidola et al. | 204/290 F X |
| 4,133,730 | 1/1979 | DuBois et al. | 204/290 F X |

*Primary Examiner*—Howard S. Williams
*Assistant Examiner*—D. R. Valentine
*Attorney, Agent, or Firm*—Sughrue, Rothwell, Mion, Zinn and Macpeak

[57] ABSTRACT

An alloy for use as a substrate of an electrode for use in electrolysis, the alloy comprising (1) titanium and (2) 0.05 to 10% by weight of (a) tantalum and (b) niobium, zirconium or mixtures thereof, where the tantalum is present in an amount of 0.01 to 9.99% by weight, with each % by weight being based on the weight of the alloy. The alloy can additionally contain (3) 0.001 to 1 5% by weight of at least one platinum-group metal selected from the group consisting of platinum, iridium, rhodium, ruthenium, palladium and osmium, with the % by weight being based on the weight of the alloy. The alloy of this invention is an excellent material to prepare a corrosion-resistant electrode substrate.

2 Claims, 1 Drawing Figure

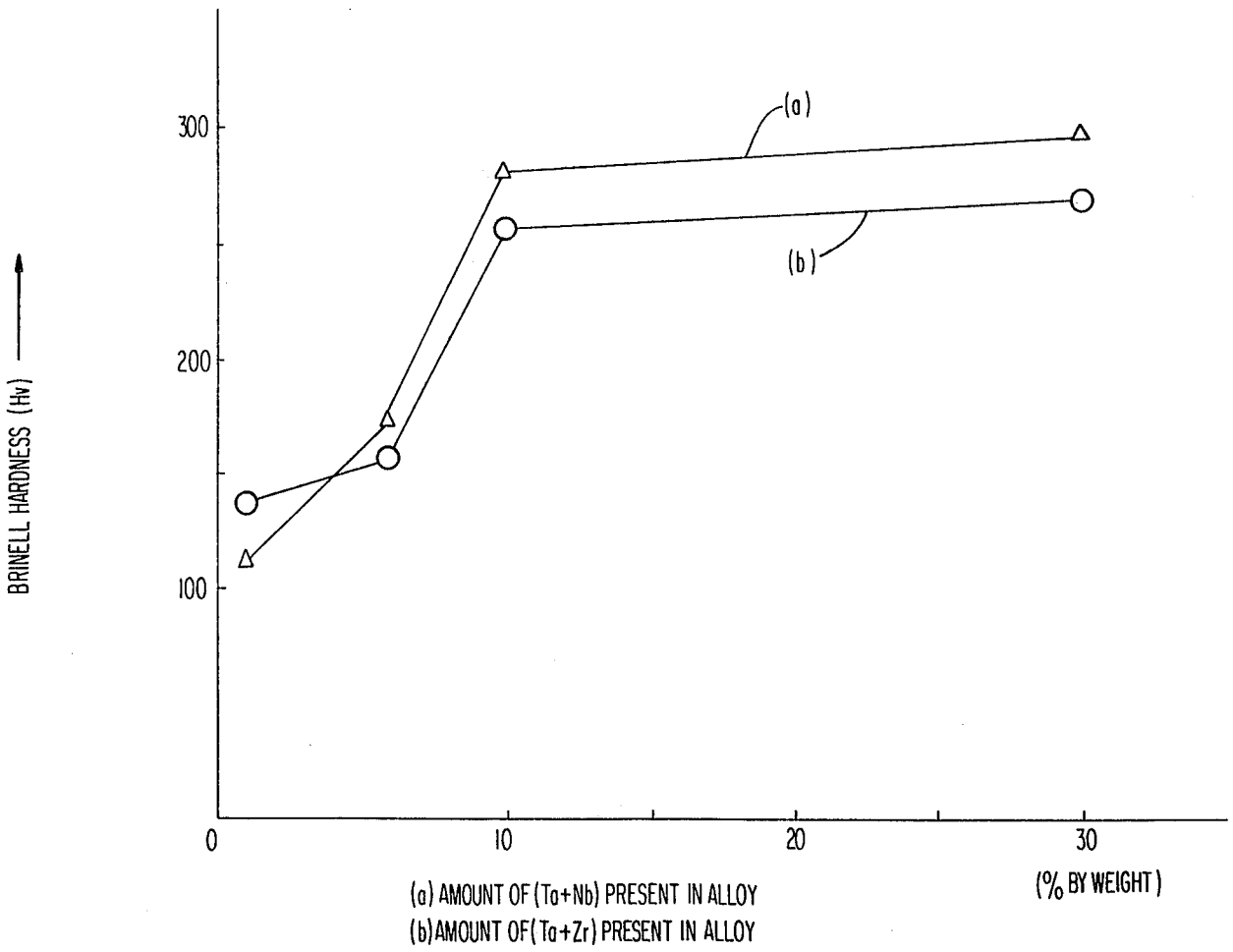
BRINELL HARDNESS (Hv)
300
200
100
0
10
20
30
(% BY WEIGHT)
(a)
(b)
(a) AMOUNT OF (Ta+Nb) PRESENT IN ALLOY
(b) AMOUNT OF (Ta+Zr) PRESENT IN ALLOY

ELECTRODE SUBSTRATE ALLOY FOR USE IN ELECTROLYSIS

BACKGROUND OF THE INVENTION

1. Field of the Invention

This invention relates to a corrosion-resistant titanium-base alloy material for use as an electrode substrate for use in electrolysis.

2. Description of the Prior Art

In recent years, insoluble metallic electrodes made by coating a metallic substrate with a platinum-group metal such as platinum or ruthenium or an oxide thereof have gained wide commercial acceptance as electrodes for use in the electrolysis of aqueous solutions of salts such as sodium chloride or sea water, aqueous solutions containing various acids such as sulfuric acid, nitric acid, hydrochloric acid or organic acids, and aqueous solutions containing alkalies. Pure titanium has been used as the metallic substrate.

When pure titanium is used as a material for an electrode substrate, the substrate surface sometimes is oxidized or is dissolved during the electrolysis of the various materials described above, particularly during the electrolysis of acidic aqueous solutions. Furthermore, in some cases, the substrate is corroded by acidic electrolyte solutions or solutions of the electrolysis product which penetrate through cracks or pinholes in the electrode coating layers. This accelerates the peeling off of or consumption of the electrode coating, and shortens the life of the electrode.

On the other hand, corrosion-resistant alloys consisting of titanium as a base and various other metals, for example, alloys of titanium and platinum-group metals (as disclosed in Japanese Patent Publication No. 6053/58) and an alloy of titanium and niobium (as disclosed in Japanese Patent Publication No. 15007/78) are known. It is also known to use a binary alloy consisting of titanium and zirconium, a platinum-group metal, niobium or tantalum as a substrate of an insoluble metallic electrode (as disclosed in Japanese Patent Publication No. 31510/72). However, these alloys and the substrate have poor acid resistance or bondability to electrode coatings, and are not entirely suitable from the standpoint of electrochemical durability.

SUMMARY OF THE INVENTION

The present invention has been accomplished in order to solve the above problems.

An object of this invention is to provide an alloy for an electrically conductive electrode substrate which has superior corrosion resistance, has good adhesion to electrode coatings and prolongs the life of the electrode.

According to one embodiment, this invention provides an alloy for use as a substrate of an electrode for use in electrolysis, the alloy comprising (1) titanium and (2) 0.05 to 10% by weight of (a) tantalum and (b) niobium, zirconium or mixtures thereof, where the tantalum is present in an amount of 0.01 to 9.99% by weight, with each % by weight being based on the weight of the alloy.

According to another embodiment, this invention provides an alloy for use as a substrate of an electrode for use in electrolysis, the alloy comprising (1) titanium, (2) 0.05 to 10% by weight of (a) tantalum and (b) niobium, zirconium or mixtures thereof, where the tantalum is present in an amount of 0.01 to 9.99% by weight, and (3) 0.001 to 1.5% by weight of at least one platinum-group metal selected from the group consisting of platinum, iridium, rhodium, ruthenium, palladium and osmium, with each % by weight being based on the weight of the alloy.

BRIEF DESCRIPTION OF THE ACCOMPANYING DRAWING

The FIGURE is a graphical representation showing the relationship between the composition of the alloy of this invention as the abscissa and the Brinell hardness of the alloy as the ordinate, with (a) showing such in terms of the amount of tantalum and niobium present in the alloy and with (b) showing such in terms of the amount of tantalum and zirconium present in the alloy.

DETAILED DESCRIPTION OF THE INVENTION

According to this invention, electrode substrate alloys having superior corrosion resistance in various electrolyte solutions can be obtained by adding 0.05 to 10% by weight of (a) tantalum and (b) niobium, zirconium or mixtures thereof to titanium. The corrosion resistance of the electrode substrate alloy can be further increased by including at least 0.001% by weight of at least one platinum-group metal of the class described above to the above-described substrate alloy.

The total amount of tantalum and niobium, zirconium or mixtures of niobium and zirconium to be added to the titanium which is required to achieve corrosion resistance should be at least 0.05% by weight. As shown in the FIGURE, when the total amount of these metals exceeds 10% by weight, the hardness of the alloy increases, and the processability of the alloy is very much reduced. Thus, a suitable amount of tantalum and niobium and/or zirconium is 0.05 to 10% by weight in the total alloy. By adding niobium and/or zirconium in an amount within the above range to titanium and tantalum depending on the type of material for the electrode coating, an electrode substrate alloy having increased adhesion to the electrode coating material can be obtained. The amount of the tantalum with the niobium and/or zirconium in the alloy can be 0.01 to 9.99% by weight.

The platinum-group metal selected from platinum, iridium, rhodium, palladium and osmium produces the effect described above when the platinum-group metal is present in an amount of at least 0.001% by weight. Since the use of a large amount of the platinum-group metal adds to the cost of production, the preferred upper limit of the platinum-group metal should be about 1.5% by weight.

The electrode substrate alloy of this invention exhibits superior effects as an anode, but the alloy of this invention is not limited thereto. The alloy of this invention can be used also as a cathode and other uses where corrosion-resistant materials are required.

The method for producing the electrode substrate alloy of this invention is not particularly restricted. It can be easily reproduced by conventionally known techniques, for example, using a vacuum arc melting method, e.g., as disclosed in *The Science, Technology and Applications of Titanium,* R. I. Jaffee and N. E. Promisel, Eds., pp. 57–71, Pergamon Press. Suitable starting materials which can be used include the above described metals, with a purity of, for example, ASTM Grade 1.

Suitable coatings which can be applied to the electrode substrate of this invention are not limited and exemplary coatings are described in, e.g., U.S. Pat. Nos. 3,632,498 and 3,711,385.

The following Examples are given to illustrate this invention in greater detail. However, the present invention is not to be construed as being limited to these Examples.

Unless otherwise indicated herein, all parts and percents are by weight.

EXAMPLES

Electrode substrate materials composed of alloys of various compositions as set forth in Table 1 below were each cast using vacuum arc melting. Each of the resulting disc-like titanium-base alloy ingots having a diameter of 50 mm and a thickness of 10 mm was hot-forged at 900° C., annealed in vacuum (about $10^{-4}$ Torr) at 700° C. for 2 hours, and cut into a size of 3.0 mm×50 mm×50 mm. Thus, plate-like electrode substrate alloys were obtained. The electrode substrates produced were washed with hot hydrochloric acid (boiling 25 wt.% HCl aqueous solution), and then with water.

A mixture of 1 g of iridium chloride as iridium metal, 0.5 g of tantalum chloride as tantalum metal and 10 ml of a 10% by weight aqueous solution of hydrochloric acid was coated on each of the electrode substrates, produced as described above, and fired at about 550° C. in air to form a metallic electrode coated with a metal oxide (layer thickness: about 2μ).

Each of the electrodes obtained was used as an anode, and evaluated by use in electrolysis in a 15% aqueous solution of sulfuric acid under the following conditions (a) and (b).

(a) Electrolyte Solution Temperature: 90° C.
Current Density: 50 A/dm$^2$ (b) Electrolyte Solution Temperature: 50° C.
Current Density: 75 A/dm$^2$ The lives of the electrodes were measured to examine the performance of the electrode substrate alloys.

The results obtained are shown in Table 1 below together with the results of comparisons in which other electrode substrates, produced also by vacuum arc melting of the metals shown also in Table 1 below, and then coated with a mixture of iridium chloride, tantalum chloride and an aqueous solution of hydrochloric acid and then fired as described above, were used.

The life of the electrode in the electrolysis was determined by the degree of peeling of the electrode coating and the abrupt rise of the electrode potential which is ascribable to oxides, etc., formed by the corrosion of the electrode substrate.

TABLE 1

| | Alloy Composition (wt. %) | | | | | | Life | |
|---|---|---|---|---|---|---|---|---|
| | | | | | | | (a) | (b) |
| Sample No. | Ti | Ta | Nb | Zr | Pt | Ir | (hours) | (months) |
| Comparison | | | | | | | | |
| 1 | 100 | — | — | — | — | — | 200 | 4 |
| 2 | 95 | 5 | — | — | — | — | 160 | — |
| 3 | 95 | — | 5 | — | — | — | 80 | — |
| 4 | 95 | — | — | 5 | — | — | 190 | — |
| Invention | | | | | | | | |
| 5 | 99 | 0.5 | 0.5 | — | — | — | 480 | 8 |
| 6 | 98 | 1 | 1 | — | — | — | 430 | — |
| 7 | 94 | 3 | 3 | — | — | — | 480 | — |
| 8 | 90 | 5 | 5 | — | — | — | 400 | — |
| 9 | 99 | 0.5 | — | 0.5 | — | — | 480 | 8 |
| 10 | 98 | 1 | — | 1 | — | — | 450 | — |
| 11 | 94 | 3 | — | 3 | — | — | 450 | — |
| 12 | 90 | 5 | — | 5 | — | — | 400 | — |
| 13 | 98.9 | 0.5 | 0.5 | — | 0.1 | — | 550 | 8.5 |
| 14 | 98 | 0.5 | 0.5 | — | 0.7 | 0.3 | 570 | — |

The data given in Table 1 above show that the electrodes made by using the electrode substrate alloys of this invention have a life which is more than two times longer than the life of conventional electrode substrate materials shown in the comparisons, and that the electrode substrate alloys of this invention are superior as electrode substrates for use in electrolysis.

While the invention has been described in detail and with reference to specific embodiments thereof, it will be apparent to one skilled in the art that various changes and modifications can be made therein without departing from the spirit and scope thereof.

What is claimed is:

1. An alloy for use as a substrate of an electrode for use in electrolysis, said alloy comprising (1) titanium and (2) 0.05 to 10% by weight of (a) tantalum and (b) niobium, zirconium or a mixture thereof, wherein the tantalum is present in an amount of 0.01 to 9.99% by weight, with each % by weight being based on the weight of the alloy.

2. The alloy of claim 1, wherein said alloy additionally contains (3) 0.001 to 1.5% by weight of at least one platinum-group metal selected from the group consisting of platinum, iridium, rhodium, ruthenium, palladium and osmium, with the % by weight being based on the weight of the alloy.

* * * * *